US006343975B1

(12) United States Patent
Mok

(10) Patent No.: US 6,343,975 B1
(45) Date of Patent: Feb. 5, 2002

(54) CHEMICAL-MECHANICAL POLISHING APPARATUS WITH CIRCULAR MOTION PADS

(76) Inventor: Peter Mok, 1647 Lombard St., San Francisco, CA (US) 94123

( * ) Notice: Subject to any disclaimer, the term of this patent is extended or adjusted under 35 U.S.C. 154(b) by 0 days.

(21) Appl. No.: 09/412,964

(22) Filed: Oct. 5, 1999

(51) Int. Cl.[7] ..... B24B 1/00
(52) U.S. Cl. ..... 451/41; 451/287; 451/285
(58) Field of Search ..... 451/41, 287, 288, 451/289, 397, 398, 400, 285

(56) References Cited

U.S. PATENT DOCUMENTS

| | | | | | |
|---|---|---|---|---|---|
| 4,617,762 | A | * | 10/1986 | Hoglund | 451/400 |
| 4,910,155 | A | | 3/1990 | Cote et al. | 437/8 |
| 4,940,507 | A | | 7/1990 | Harbarger | 156/636 |
| 5,081,795 | A | | 1/1992 | Tanaka et al. | 51/131.1 |
| 5,205,082 | A | | 4/1993 | Shendon et al. | 51/283 R |
| 5,230,184 | A | | 7/1993 | Bukman | 51/283 R |
| 5,232,875 | A | | 8/1993 | Tuttle et al. | 437/225 |
| 5,234,867 | A | | 8/1993 | Schultz et al. | 437/225 |
| 5,329,732 | A | | 7/1994 | Karlsrud et al. | 51/131.5 |
| 5,335,453 | A | | 8/1994 | Baldy et al. | 51/67 |
| 5,384,986 | A | | 1/1995 | Hirose et al. | 451/444 |
| 5,554,064 | A | | 9/1996 | Breivogel et al. | 451/41 |
| 5,582,534 | A | | 12/1996 | Shendon et al. | 451/41 |
| 5,584,751 | A | | 12/1996 | Kobayashi et al. | 451/288 |
| 5,655,954 | A | * | 8/1997 | Oishi et al. | 451/288 |
| 5,759,918 | A | | 6/1998 | Hoshizaki et al. | 438/692 |
| 5,810,648 | A | * | 9/1998 | Jiang et al. | 451/41 |
| 5,820,448 | A | * | 10/1998 | Shamouilian et al. | 451/41 |
| 5,851,136 | A | | 12/1998 | Lee | 451/9 |
| 5,931,725 | A | * | 8/1999 | Inaba et al. | 451/288 |
| 5,951,373 | A | * | 9/1999 | Shendon et al. | 451/41 |
| 5,975,991 | A | * | 11/1999 | Karlsrud | 451/41 |
| 6,019,670 | A | * | 3/2000 | Cheng et al. | 451/443 |
| 6,036,582 | A | * | 3/2000 | Aizawa et al. | 451/41 |
| 6,056,630 | A | * | 5/2000 | Nanda et al. | 451/41 |
| 6,095,904 | A | * | 8/2000 | Brevogel et al. | 451/41 |
| 6,168,683 | B1 | * | 1/2001 | Cesna | 451/287 |

* cited by examiner

*Primary Examiner*—Derris H. Banks
*Assistant Examiner*—Hadi Shakeri
(74) *Attorney, Agent, or Firm*—Skjerven Morrill MacPherson LLP; Edward C. Kwok

(57) ABSTRACT

A method and apparatus provide polishing of a semiconductor wafer or other substrate. The apparatus includes multiple wafer carriers provided on the top surface of a table. A semiconductor wafer is seated face-up in the wafer carrier. Each wafer carrier is driven by an electric motor to rotate at a low speed. During operation, each wafer carrier is positioned at a work station where a specified task is performed. The table rotates when the task at each station is completed to move the wafers from station to station. Thus multiple tasks relating to polishing (e.g., buffing and drying) can be carried out in parallel. At one station, a polishing pad is positioned by a polishing pad carrier face-down to polish the surface of the semiconductor wafer. A motor drives the polishing pad to move in a high-speed circular motion.

23 Claims, 5 Drawing Sheets

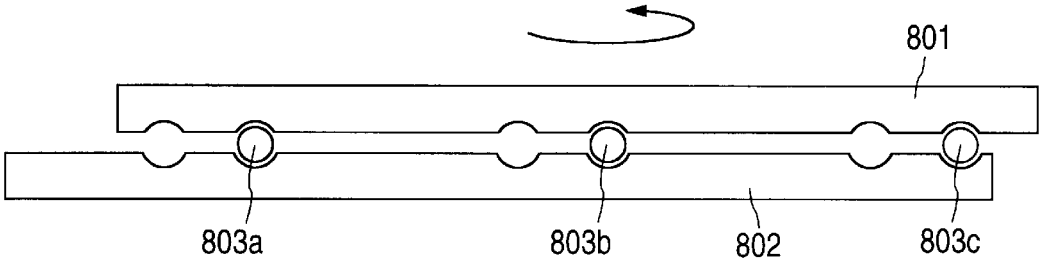
FIG. 9
FIG. 10a
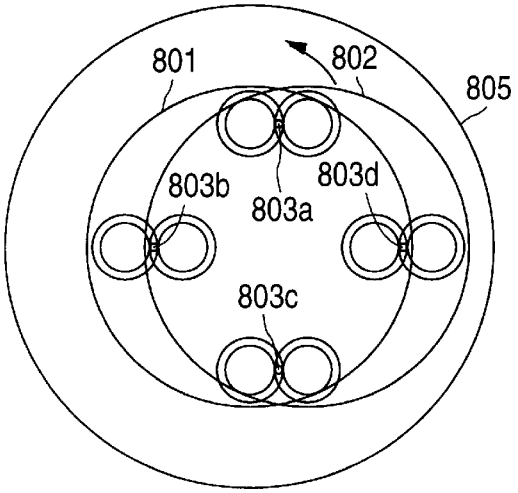
FIG. 10d
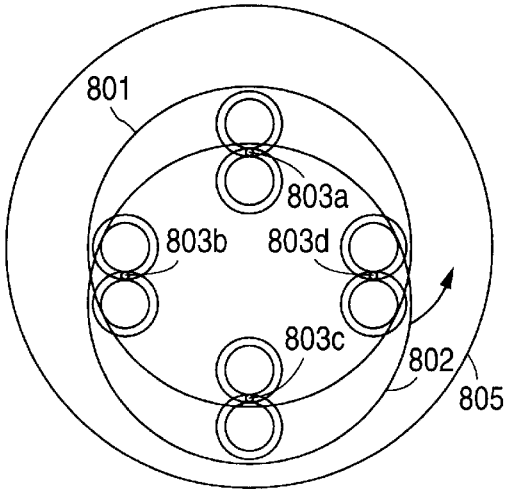
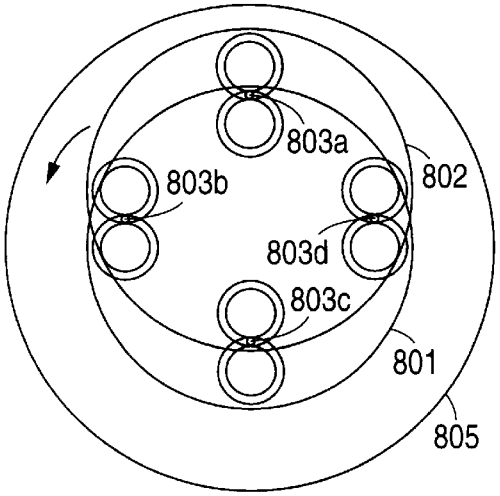
FIG. 10b
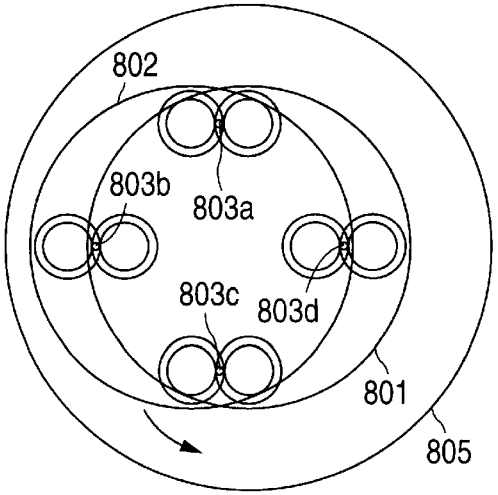
FIG. 10c

CHEMICAL-MECHANICAL POLISHING APPARATUS WITH CIRCULAR MOTION PADS

BACKGROUND OF THE INVENTION

1. Field of the Invention

The present invention relates to chemical-mechanical polishing (CMP) of semiconductor wafers. In particular, the present invention relates to an apparatus providing simultaneously polishing of multiple wafers.

2. Discussion of the Related Art

In integrated circuit manufacturing, CMP is widely used for planarizing the surface of the semiconductor wafer to allow multiple layers of conductors and dielectric to be formed.

In the prior art, CMP is achieved by pressing a semiconductor wafer against a polishing pad provided on a high-speed rotating table or a linear motion polishing belt. Typically, the semiconductor wafer is held by a wafer carrier, which also rotates. A slurry, typically including fine silicon oxide particles suspended in an alkaline solution, is provided as a chemically active abrasive.

In CMP using a rotational table, because each point on a semiconductor wafer experiences a polishing speed that depends, among other factors, the distance from the rotating table's axis of rotation and its own speed of rotation, uniformity of polishing across the wafer is very difficult to achieve. Furthermore, because of the complex motion, the wear and tear on the polishing pad at different points of the rotating table are also non-uniform, also contributing to non-uniform polishing results.

Linear polishing eliminates some of the contributing factors of non-uniformity. However, because the contact surface areas at different points of the polishing pads are different, polishing non-uniformity is still difficult to achieve.

SUMMARY OF THE INVENTION

The present invention provides a method and an apparatus for accomplishing chemical-mechanical polishing of a wafer using a non-rotatory circular motion. This circular motion polishes every point on a wafer equally and also imparts equal wear and tear at every point of the polishing pad. Better uniformity than achievable in the prior art is therefore achieved.

According to one aspect of the present invention, an apparatus for polishing of a wafer includes (a) a wafer holder for holding the wafer so as to expose a surface of the wafer for polishing; (b) a polishing pad holder for holding a polishing pad against the exposed surface; and an actuator coupled to the polishing pad holder for driving the polishing pad in a non-rotatory circular motion so as to provide polishing action against the exposed surface of the wafer. In one embodiment, the apparatus multiple wafer holders are provided on a rotatable table, such that tasks related to chemical-mechanical polishing (CMP) of the wafer can be carried out simultaneously at stations around the rotatable table. In one embodiment of the present invention, the wafer holder includes a raised wall for containing a slurry used in polishing.

In one implementation, the actuator includes a motor which drives an off-center shaft to provide the non-rotatory circular motion. In that implementation, a linear bearing couples the polishing pad holder to the actuator, such that the off-center shaft, the linear bearing and the motor are enclosed in multiple connected chambers. In that arrangement, a pressurized air flow is provided to flow through the multiple connected chambers to effectuate cooling of the motor.

In one embodiment, the apparatus provides the polishing pad holder and the actuator in each of two polishing assemblies. In addition, a conditioning station is provided, so that when one of the polishing assemblies is positioned for polishing the wafer, the polishing pad in the other polishing assembly is positioned at the conditioning station for conditioning. A diamond plate on a rotatable platform is provided at the conditioning station. Conditioning is carried out by pressing the polishing pad against the rotating diamond plate.

In one implementation of the apparatus, an actuator is provided for rotating the wafer in the wafer holder during polishing.

According to another aspect of the present invention, the wafer holding includes an wafer edge extension ring which surrounds the wafer. The wafer edge extension ring has a surface flush with the surface of the wafer being polished, so that the edge of the wafer is "extended" to the outer edge of the extension ring. Since polishing is carried out over the surfaces of the wafer and the wafer edge extension ring, edge effects are substantially eliminated.

In one implementation of the apparatus, the wafer is supported by a housing seated on a rotatable platform. The housing is provided an inlet into a recessed portion of the housing underneath the wafer holder, and a flexible seal is provided over the recessed portion of the housing in contact with a surface of the wafer holder. Under this arrangement, a chamber is formed under the surface of the wafer holder. A gas can then be introduced into the chamber through the inlet to allow a pressure to be applied against the wafer holder. The polishing pressure can then be controlled by adjusting the pressure on the flexible seal.

The present invention is better understood upon consideration of detailed description below and the accompanying drawings.

BRIEF DESCRIPTION OF THE DRAWINGS

FIG. 9 is a cross section view of bearing assembly 820.

FIGS. 10*a*–10*d* show, respectively, the positions of upper plate 801 and lower plate 802 at four different positions during operation.

DETAILED DESCRIPTION OF THE PREFERRED EMBODIMENTS

Figure 1:
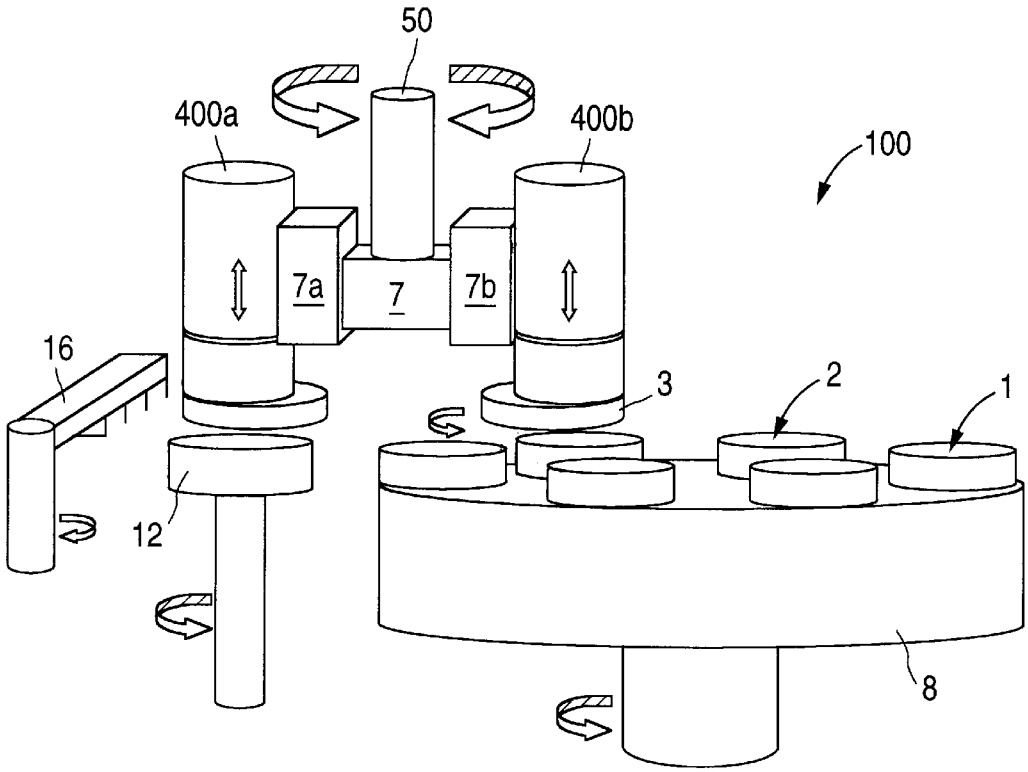
FIG. 1 is a perspective view of CMP apparatus 100, according to one embodiment of the present invention.
Figure 2:
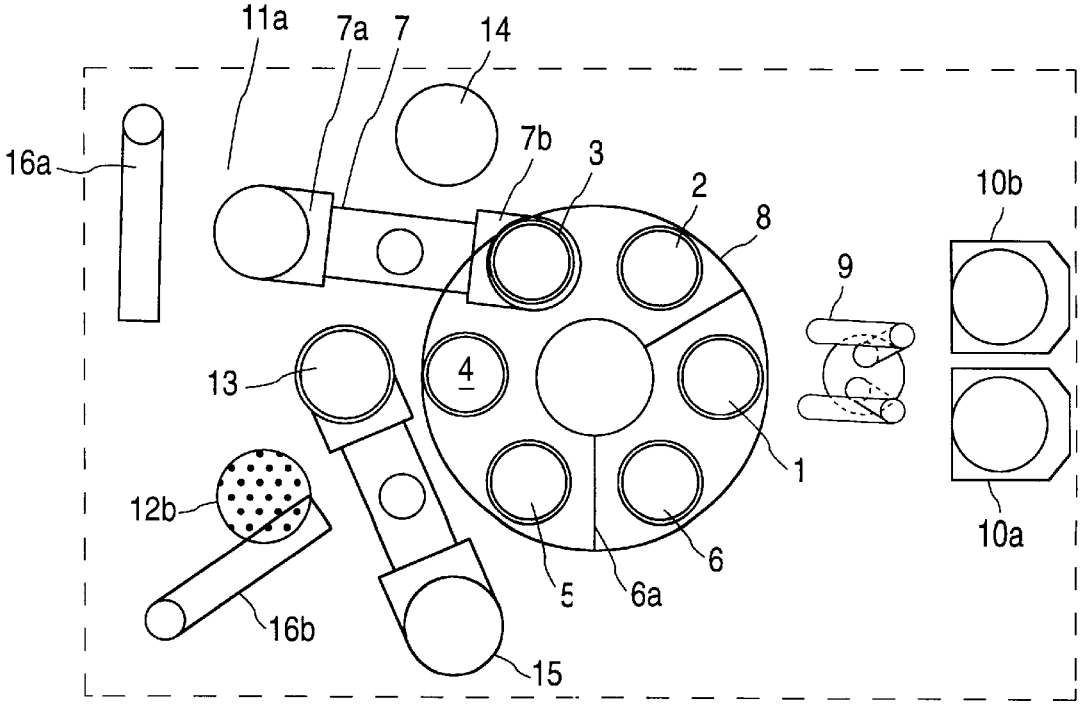
FIG. 2 is a top view of CMP apparatus 100.

FIGS. 1 and 2 show a perspective view and a top view of a chemical mechanical polishing (CMP) apparatus 100, respectively, according to one embodiment of the present invention. As shown in FIGS. 1 and 2, in CMP apparatus 100, a table 8 transports semiconductor wafers in wafer carrier assemblies for processing at stations 1–6, located 60 degrees apart relative to table 8's axis of rotation. (The number of stations shown in FIG. 2 are provided merely for illustrative purpose; as many stations as practicable and necessary can be provided). An example of a wafer carrier assembly is wafer carrier assembly 500 shown in FIG. 5.

Each of stations 1–6 performs a designated task on one semiconductor wafer under process. At any given time, all wafer stations are active, so that multiple wafers are simultaneously processed on table 8. To complete processing, a semiconductor wafer to be processed is loaded at station 1 and is successively rotated in six steps through each of wafer stations 2–6, finally returning to station 1 for unloading.

At station 1, a semiconductor wafer is loaded and unloaded from one side by robot assembly 9. A robotic arm in robot assembly 9 picks up from a wafer carrier on table 8 a semiconductor wafer that has completed processing, and deposits the semiconductor wafer into wafer cassette 10*a*. Then, the same or another robotic arm in robot assembly 9 picks up a semiconductor wafer to be processed from wafer cassette 10*b* and places the wafer on to the wafer carrier just unloaded.

At station 2, a slurry-filling step is performed. In the slurry-filling step, a specified amount of slurry is introduced into the wafer carrier to "flood" the semiconductor wafer surface, in preparation for the CMP step at station 3.

Figure 4:
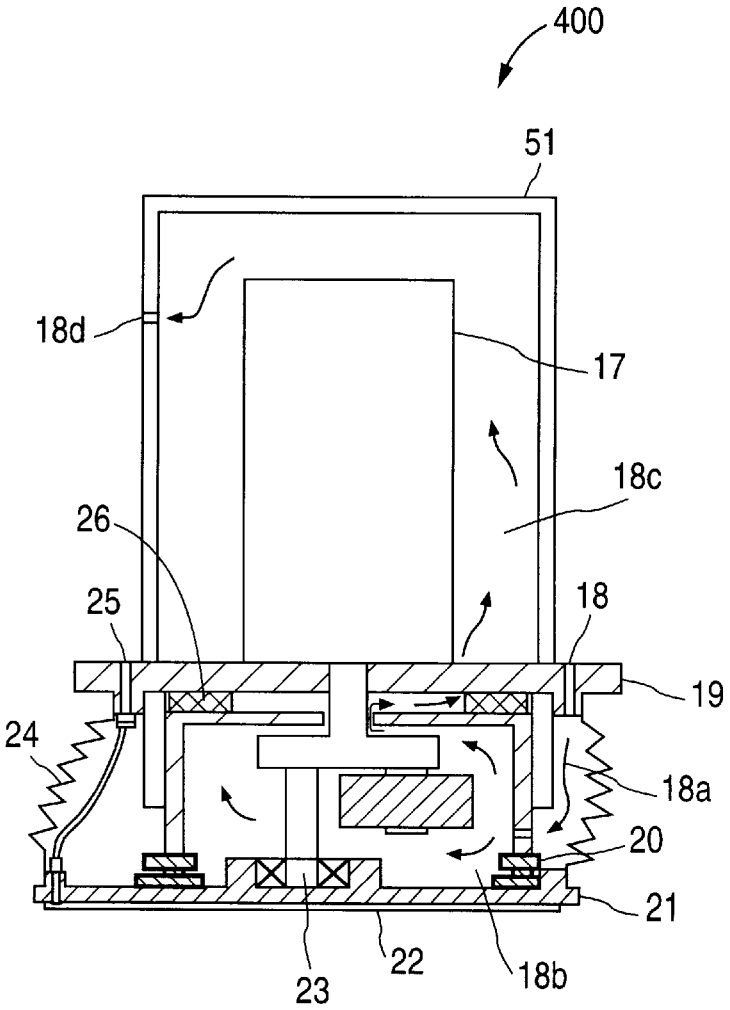
FIG. 4 is a cross-section view of polishing assembly 400, including polishing pad carrier 21 and polishing motor 17.

At station 3, a CMP step is performed by a polishing pad in circular motion. The polishing pad is held by a polishing assembly (e.g., polishing 400*a*). An example of a polishing assembly 400 is shown in FIG. 4. While polishing is carried out by the polishing pad at station 3, another polishing pad held in another polishing assembly (e.g., polishing assembly 400*b*) is being conditioned by conditioning diamond plate 12 at conditioning station 11. Conditioning of a polishing pad after each CMP step can improve polishing uniformity. In this embodiment, polishing assemblies 400*a* and 400*b* are rotated by a shaft 50 alternately into station 3 and conditioning station 11. Polishing assemblies 400*a* and 400*b* are coupled respectively to linear mechanisms 7*a* and 7*b*. Linear mechanisms 7*a* and 7*b* each include linear bearings which allow polishing assemblies 400*a* and 400*b* to be vertically positioned for CMP. At station 3, the wafer carrier on table 8 rotates at a low speed relative to the speed of the polishing pad's circular motion. The operations of polishing assemblies 400*a* and 400*b* are discussed in further detail below.

During conditioning, diamond plates 12*a* rotates at a low speed similar to that of the wafer carrier. Cleaning arm 16*a* includes a cleaning mechanism for cleaning diamond plate 12*a* periodically to ensure uniformity of conditioning. Polishing pads are changed at station 14. Depositing a used polishing pad and picking up a new polishing pad are performed by vacuum action in the polishing pad assembly.

At station 4, the slurry is washed out of the wafer carrier by water. At station 5, a fine polishing and/or cleaning step ("buffing") is carried out. In this embodiment, the operation of the buffing step is similar to that of the polishing step in station 3. The polishing pads for buffing are also conditioned at conditioning station 12*b* in a manner similar to that described above for conditioning station 11. Cleaning arm 16*b* is shown in FIG. 2 to be performing the periodic cleaning operation on diamond plates 12*b*. Polishing pads for the buffing operation are changed at station 15 in a manner similar to that described above for station 14.

At station 6, the semiconductor wafer is rinsed and dried.

FIG. 4 is a cross-section view of polishing assembly 400, which forms an actuator including housing 51, polishing pad carrier 21 and polishing motor 17. Polishing pad carrier 21 is coupled by linear bearing 20 to housing 51. Polishing pad carrier 21 holds polishing pad 22. The surface area of polishing pad 22 approximates the surface area of the wafer carrier assembly open to the polishing pad.

Figure 3:
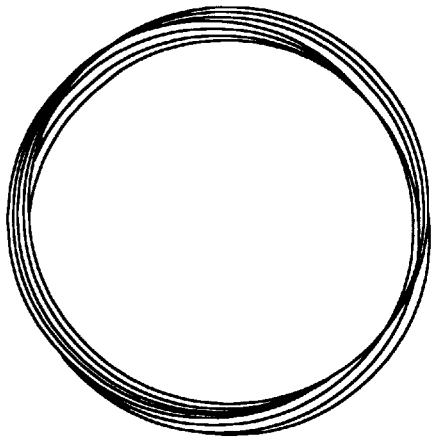
FIG. 3 illustrates the motion of one point on a polishing pad relative to housing 18 of polishing motor 17.

Motor 17 drives off-center shaft 23 to impart a circular motion to polishing pad carrier 21 during operation. This circular motion is not rotational about the axis of off-center shaft 23. FIG. 3 shows the locus of motion of any point on the polishing pad. Unlike the prior art rotating table or linear polishing approaches, under this arrangement, every point in both the polishing pad and the semiconductor wafer surface experience substantially identical polishing action. Thus, the present invention provides more uniform polishing than the prior art approaches.

Figure 8:
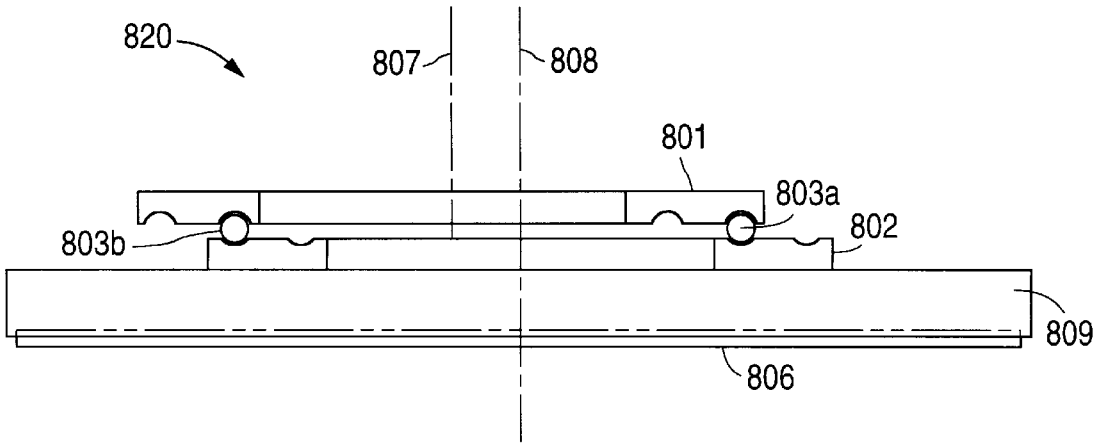
FIG. 8 shows, instead of bellows 24, a special bearing assembly 820 provides support for the non-rotatory circular motion of polishing pad holder 809 (hence the motion of polishing pad 806).

Polishing pad carrier 21, bellows 24 and linear bearing support plate 19 provides a sealed environment enclosing linear bearing 20 and off-center shaft 23. Bellows 24 prevents any rotational motion about off-center shaft 23. Alternatively, as shown in FIG. 8, instead of bellows 24, a special bearing assembly 820 provides support for the non-rotatory circular motion of polishing pad holder 809 (hence the motion of polishing pad 806). Bearing assembly 820 includes an upper plate 801, a lower plate 802 and a plurality of ball bearings, represented in this embodiment by ball bearings 803*a*–803*d*. The rotation of upper plate 801 about off-axis 807 (relative to axis 808 at the center of polishing pad holder 809) provides the non-rotatory circular motion.

FIG. 9 is a cross section view of bearing assembly 820. FIG. 10*a*–10*d* show, respectively, the positions of upper plate 801 and lower plate 802 at four different positions during operation. FIGS. 10*a*–10*d* show four different positions (approximately 90 degrees apart) along the polishing pad path traveled by polishing pad 806 over wafer carrier 805. Upper and lower plates 801 and 802 are each a plate with a number of circular grooves with substantially semicircular cross sections. The circular grooves of upper and lower plates are positioned such that, at any given time, as shown in each of FIGS. 10*a*–10*d*, each circular groove overlaps a corresponding circular groove to form a spherical cavity where a ball bearing (e.g., any of ball bearings 803*a*–803*d*) is accommodated. As upper plate 801 rotates about axis 807, each ball bearing travels along both the circular grooves of upper and lower plates 801 and 802. As a result, lower plate 802 carries polishing pad 806 in the non-rotatory circular motion.

A cooling air flow through polishing assembly 400 is provided to polishing assembly 400. Air enters into polishing assembly 400 through inlet 18, through chambers 18*a*, 18*b*, and 18*c* (in order) and exits through outlet 18*d*. Typically, the cooling air flow cools the surface of the polishing assembly sufficiently to provide a moisture condensation which prevents the slurry from drying up in the wafer carrier and on the outside of bellows 24. The pressure in chambers 18*a*, 18*b* and 18*c* are sufficiently low so as to lessen the force asserted by loaded linear bearing 20 against the semiconductor wafer surface. This lessened pressure allows better control of polishing rate and, consequently, better control of polish uniformity.

Figure 5:
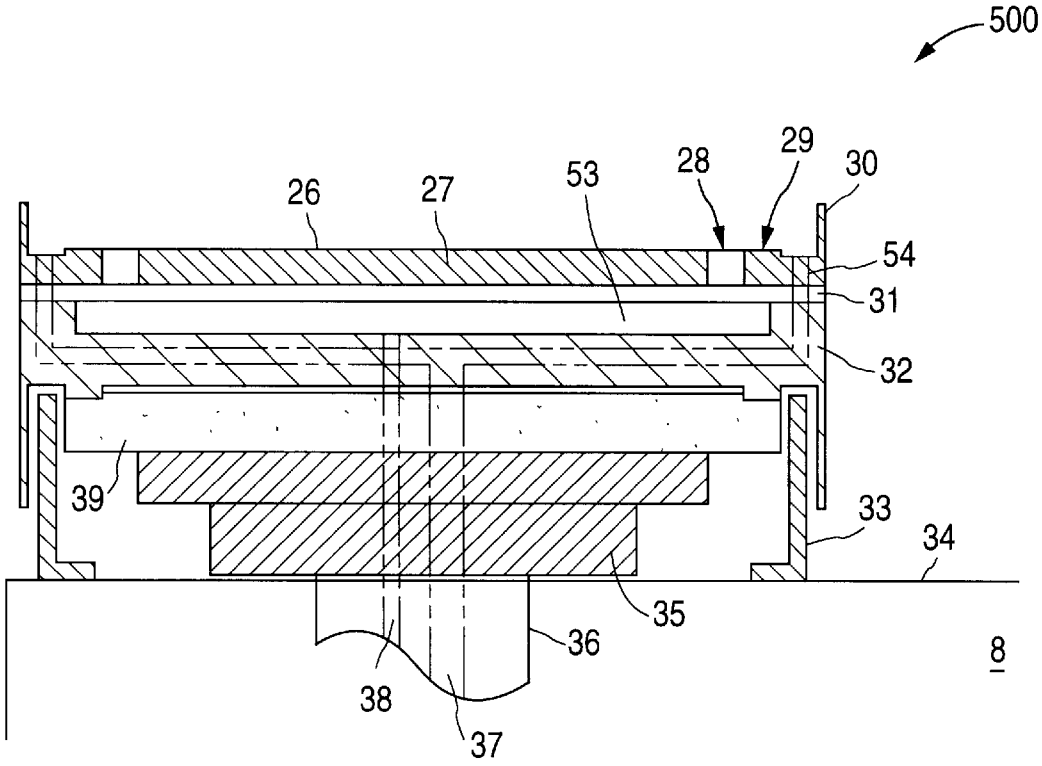
FIG. 5 is a cross-section view of wafer carrier assembly 500.

FIG. 5 is a cross-sectional view of wafer carrier assembly 500. As shown in FIG. 5, wafer carrier assembly 500 includes an actuator for supporting and imparting motion to wafer carrier 54. Wafer carrier 54 has a circular cavity for accommodating plate 27, wafer edge extension ring 28 and guide ring 29, and raised wall 30 for containing the slurry flooding the semiconductor surface during CMP. Plate 27 has a flat surface over which is coated a friction film for supporting a semiconductor wafer. Plate 27 has a diameter substantially the same as that of the semiconductor wafer, indicated by reference numeral 26. Wafer edge extension ring 28, which extends the surface area open to the opposing polishing pad, surrounds plate 27. Guide ring 29 surrounds and positions wafer edge extension ring 28. Plate 27, wafer edge extension ring 28 and guide ring 29 are supported by housing 32 which, through flexible seal 31, transmits a pressure against the semiconductor wafer. The pressure is provided by pressured air applied from the chamber 53 below seal 31. Plate 27 and wafer edge extension ring 28 can be removed independently. Guide ring 29, the surface of wafer 26 and wafer edge extension ring 28 form the surface of the wafer carrier assembly open to the polishing pad (not shown). Wafer edge extension ring 28 is designed to be flush with the semiconductor wafer surface to receive the same polishing action as the semiconductor wafer. Essentially, the edge of the semiconductor wafer is now positioned well inside the outer edge of the polishing surface, which is "extended" to the outer edge of the wafer edge extension ring 28. Consequently, "edge effects" at the wafer edge characteristic in CMP are substantially minimized. Guide ring 29 guides the motion of the polishing pad in plane parallel to the wafer surface.

Housing 32 sits on base plate 39 of table 35, which can be rotatably driven by shaft 36. As explained above, during CMP, table 35 rotates at a low speed (relative to the speed of the polishing pad's circular motion). Seal ring 33 prevents the slurry from flowing into the shaft area.

Friction resulting from the polishing action tends to coerce the semiconductor wafer to follow the circular motion of the polishing pad. However, because of the speed of the polishing pad, the semiconductor wafer cannot keep up with the motion of the polishing pad. However, the circular motion tends to lessen the force exerted the wafer against the wafer edge extension ring, relative to the force that would be exerted by either the planetary motion of a rotating table or a linear polishing belt. Consequently, deformity of the edge of the semiconductor wafer is reduced, with corresponding improvement of polishing uniformity along the edge of the semiconductor wafer. This beneficial effect is expected even for 300 mm semiconductor wafers.

Figure 6:
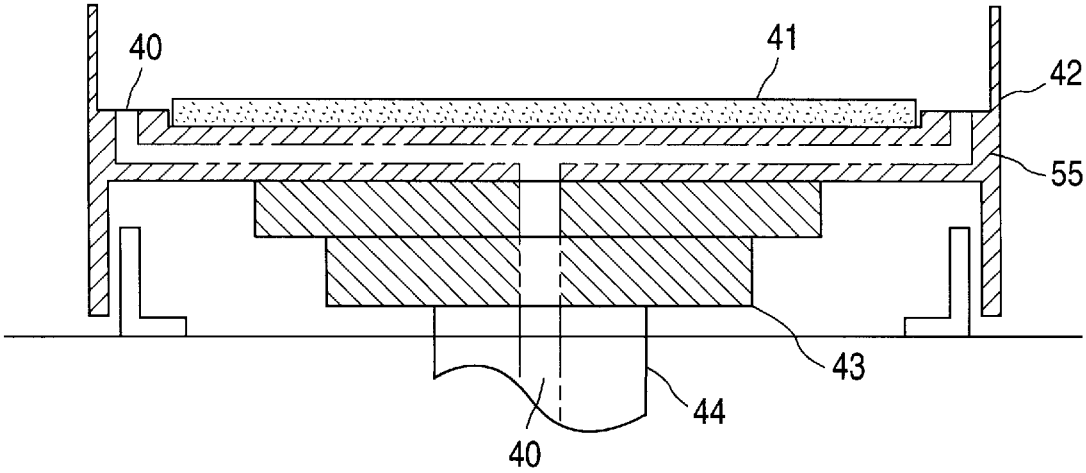
FIG. 6 is a cross-section view of conditioning assembly 600.

FIG. 6 is a cross-section view of conditioning assembly 600. As shown in FIG. 6, conditioning assembly 600 includes a diamond plate (indicated by reference numeral 41) seated in a housing 55. Housing 55 has raised wall 42 for containing a conditioning fluid used in conditional a polishing pad. Drain hole 40 is provided for draining conditioning assembly 600 with conditioning fluid. Table 43 is rotatably driven by shaft 40.

Figure 7:
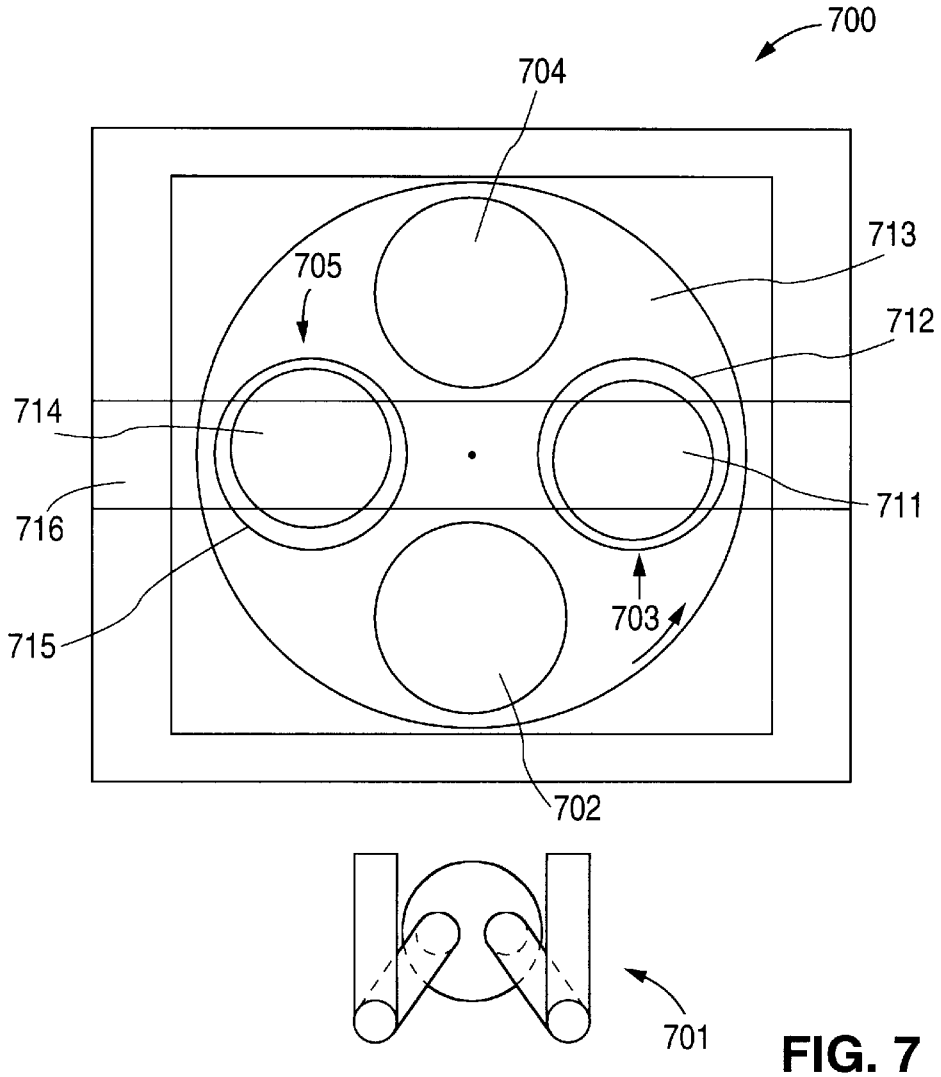
FIG. 7 is a top view of CMP apparatus 700, according to a second embodiment of the present invention.

FIG. 7 is a top view of CMP apparatus 700, in accordance with a second embodiment of the present invention. As shown in FIG. 7, CMP apparatus 700 includes 5stations 701 to 705. A wafer to be polished is loaded by a robotic assembly at station 701 onto a wafer holder on rotatable table 713 at the beginning of processing, and unloaded from rotatable table 713 by the robotic assembly at the end of processing. Rotatable 713 rotates in 90 degree steps to carry the wafer through stations 702 through 705 to complete the polishing process. In CMP appartus 700, stations 702 and 704 are provided to perform one or more steps of rinsing, cleaning, conditioning of polishing pads, and changing polishing pads. Polishing and buffing are performed at stations 703 and 705 by polishing heads 711 and 714, respectively.

The detailed description above is provided to illustrate the specific embodiments of the present invention and is not intended to be limiting. Numerous variations and modifications within the scope of the present invention are possible. The present invention is set forth in the following claims.

I claim:

1. An apparatus for polishing of a wafer, comprising:

a rotatable table;

a wafer holder supported by said rotatable table, said wafer holder holding said wafer to expose a surface of said wafer for polishing; and a polishing pad holder for holding a polishing pad against said exposed surface; and an actuator coupled to said polishing pad holder for driving said polishing pad in an orbital circular motion, so as to provide polishing action against said exposed surface of said wafer, wherein said actuator includes a motor driving an off-center shaft which provides said orbital circular motion;

a linear bearing coupling said polishing pad holder to said actuator; and an enclosure enclosing said off-center shaft, said linear bearing and said motor, said enclosure forming multiple connected chambers to allow a pressurized air flow to cool said motor.

2. An apparatus as in claim 1, wherein said wafer holder is one of multiple wafer holders provided on said rotatable table.

3. An apparatus as in claim 2, wherein each of said multiple wafer holders is positioned at a station for performing a task related to chemical-mechanical polishing (CMP) of semiconductor wafer.

4. An apparatus as in claim 1, wherein said wafer holder includes a raised wall for containing a slurry used in polishing.

5. An apparatus as in claim 1, wherein linear bearing positions said polishing pad against said exposed surface of said wafer.

6. An apparatus as in claim 1, wherein said polishing pad holder and said actuator forming a first polishing assembly, further comprising:

a conditioning assembly;

a second polishing assembly substantially the same as said first polishing assembly; and a positioning mechanism coupled to said first and second polishing assemblies, said positioning mechanism positioning one of said first and second polishing assemblies for polishing said wafer and simultaneously position the other one of said first and second polishing assemblies at said conditioning assembly for conditioning of the polishing pad in said other one of said first and second polishing assemblies.

7. An apparatus as in claim 6, wherein said conditioning assembly comprises:

a diamond plate on a rotatable platform; and an actuator for rotating said rotatable platform.

8. An apparatus as in claim 1, further comprising a robotic mechanism for loading said wafer into said wafer holder.

9. An apparatus as in claim 1, further comprising a second actuator coupled to said wafer holder for rotating said wafer in said wafer holder during polishing.

10. An apparatus as in claim 1, said wafer holding further comprising an wafer edge extension ring which surrounds said wafer, said wafer edge extension ring having a surface flush with said exposed surface of said wafer.

11. An apparatus as in claim 1, further comprising:

a rotatable platform;

a housing supporting said wafer holder on said rotatable platform, said housing having an inlet into a recessed portion of said housing underneath said wafer holder;

a flexible seal over said recessed portion of said housing and in contact with a surface of said wafer holder, thereby forming a chamber under said surface of said wafer holder; and means for introducing a gas into said chamber through said inlet for applying a pressure against said wafer holder.

12. A method for polishing of a wafer, comprising:

exposing a surface of said wafer for polishing; and pressing a polishing pad which is provided on a polishing pad holder against said exposed surface; and moving said polishing pad an orbital circular motion, so as to provide polishing action against said exposed surface of said wafer surface of said wafer, wherein said orbital circular motion is provided by a motor driving an off-center shaft which provides said orbital circular motion;

providing a linear bearing coupling said polishing pad holder to said actuator;

enclosing said off-center shaft, said linear bearing and said motor to form multiple connected chambers; and providing a pressurized air flow through said connected multiple chambers to cool said motor.

13. A method as in claim 12, wherein said wafer is provided on one of multiple wafer holders provided on a rotatable table.

14. A method as in claim 13, further comprising performing a task related to chemical-mechanical polishing (CMP) of semiconductor wafer at each location of said multiple wafer holders on said rotatable table.

15. A method as in claim 12, further comprising holding said wafer in a wafer holder that includes a raised wall for containing a slurry used in polishing.

16. A method as in claim 12, wherein said pressurized air flow cools said chambers sufficiently to cause moisture to condense on an external wall of said multiple chambers.

17. A method as in claim 12, further comprising positioning said polishing pad against said exposed surface of said wafer using said linear bearing.

18. A method as in claim 12, wherein said orbital circular motion is provided by first and second polishing assemblies alternately, further comprising positioning said first and second polishing assemblies, such that when one of said first and second polishing assemblies is polishing said wafer, the other one of said first and second polishing assemblies is positioned at a conditioning station for conditioning of a polishing pad in said other one of said first and second polishing assemblies.

19. A method as in claim 18, wherein said conditioning comprises pressing a rotating diamond plate against said polishing pad.

20. A method as in claim 12, further comprising loading said wafer onto a wafer holder using a robotic arm.

21. A method as in claim 12, further comprising rotating said wafer during polishing.

22. A method as in claim 20, further comprising providing an wafer edge extension ring in said wafer holder which surrounds said wafer, said wafer edge extension ring having a surface flush with a surface of said wafer.

23. A method as in claim 22, further comprising:

providing a rotatable platform;

supporting said wafer holder on said rotatable platform using a housing, said housing having an inlet into a recessed portion of said housing underneath said wafer holder;

sealing said recessed portion by a flexible seal in contact with a surface of said wafer holder, thereby forming a chamber under said surface of said wafer holder; and introducing a gas into said chamber through said inlet for applying a pressure against said wafer holder.

* * * * *